United States Patent [19]

Braun

[11] Patent Number: 4,583,911

[45] Date of Patent: Apr. 22, 1986

[54] MULTIPLE FLUID PATHWAY ENERGY CONVERTER

[75] Inventor: David L. Braun, Lake Elmo, Minn.

[73] Assignee: Minnesota Mining and Manufacturing Company, St. Paul, Minn.

[21] Appl. No.: 544,822

[22] Filed: Oct. 24, 1983

[51] Int. Cl.[4] ..... F04D 5/00

[52] U.S. Cl. ..... 415/116; 415/210; 415/213 C; 416/93 R

[58] Field of Search ..... 415/185, 219 R, 213 C, 415/209, 210, 116, 138; 416/93 R, 94

[56] References Cited

U.S. PATENT DOCUMENTS

| | | | |
|---|---|---|---|
| 1,096,694 | 5/1914 | DeVilbiss | 416/93 R |
| 1,104,963 | 7/1914 | Coanda | 60/266 |
| 2,081,210 | 5/1937 | Williams, Jr. | 416/93 R |
| 2,262,695 | 11/1941 | Moeller | 416/93 R |
| 2,801,793 | 8/1957 | Kline | 416/93 R |
| 3,178,099 | 4/1965 | Child | 415/119 |
| 3,191,377 | 6/1965 | Hiersch | 60/624 |
| 3,385,516 | 5/1968 | Omohundro | 416/1 |
| 3,405,865 | 10/1968 | Lagelbauer | 415/210 X |
| 3,449,605 | 6/1969 | Wilson | 416/93 R UX |
| 3,885,888 | 5/1975 | Warhol | 416/175 |
| 4,150,919 | 4/1979 | Matucheski | 416/93 R |
| 4,153,389 | 5/1979 | Boyd | 416/93 R |
| 4,219,325 | 8/1980 | Gutzwiller | 415/210 X |
| 4,221,540 | 9/1980 | Savonuzzi | 416/97 R |

FOREIGN PATENT DOCUMENTS

| | | |
|---|---|---|
| 1002912 | 2/1957 | Fed. Rep. of Germany . |
| 2142288 | 3/1973 | Fed. Rep. of Germany . |
| 2257800 | 8/1975 | France . |
| 785501 | 10/1957 | United Kingdom . |

OTHER PUBLICATIONS

*Fan Engineering*, Fifth Edition, 1948, particularly pps. 227 through 239.

Osborne, W. C., *Fans*, Second Edition, 1977, especially pp. 32 through 49.

Chardon, C. C., *Fan Selection*, Design News, Oct. 11, 1982.

*Primary Examiner*—Robert E. Garrett
*Assistant Examiner*—Joseph M. Pitko
*Attorney, Agent, or Firm*—Donald M. Sell; James A. Smith; William D. Bauer

[57] ABSTRACT

An axial flow energy converter combining a tubular shroud defining a fluid pathway coaxial with the shroud, a rotational energy converter having a rotatable shaft mounted within the fluid pathway coaxial with the shroud, an impeller mounted to the shaft with the impeller having a hub having a face across the fluid pathway and having an edge at the radial perimeter of the hub and having a plurality of blades mounted radially to the edge of the hub and a set of guide vanes disposed axially with respect to the impeller and mounted within the fluid pathway. The hub has at least one face orifice in the face of the hub communicating with at least one edge orifice in the edge of the hub allowing fluid to flow through the hub, providing both axial fluid flow and hub fluid flow through the energy converter.

18 Claims, 11 Drawing Figures

MULTIPLE FLUID PATHWAY ENERGY CONVERTER

BACKGROUND OF THE INVENTION

The present invention relates generally to axial flow impellers and more particularly to axial flow energy converters (e.g. fans) utilizing certain impellers.

Axial flow devices, particularly fans, are well-known in the art. One reference text in this art is William C. Osborne, *Fans, 2nd Edition (in SI/metric units)*, 1977, published by Pergamon Press, Inc., Maxwell House, Fairview Park, Elmsford, New York 10523. Particular reference may be made to chapter 2 which describes differing types of fans. The Osborne text is hereby incorporated by reference.

One application of an axial flow fan is in a fluid pumping device incorporated within a clean air hat which pumps air through a filter to a human wearer. In order to provide sufficient purified air to a wearer working in the environment where the hat is being worn, a certain minimum volumetric flow rate of air must be drawn into the hat. To enable the hat to be completely portable, it is desirable that the pumping device (fan) be battery powered. For a hat using batteries, it is preferred that the hat be as light as possible and that it be able to operate as long as posible. An axial flow fan which develops sufficient differential pressure and volumetric flow rate and minimizes battery drain (power consumption) is desirable.

In one axial flow fan designed for a clean air hat marketed under the tradename "Airhat" by Minnesota Mining and Manufacturing Company, a small electric motor is mounted within a shroud with a set of guide vanes. An impeller is attached to the motor shaft and has a central hub and a plurality of blades radially mounted to the edge of the hub with each of the blades set at an attack angle in order to pump fluid (air) through the fan. This axial flow fan exhibits certain performance characteristics of pressure differential and volumetric flow at a certain voltage and amperage (power consumption).

There is desired an axial flow fan which develops improved pressure and volumetric flow and minimizes battery drain (power consumption).

SUMMARY OF THE INVENTION

An axial flow fan is provided having a tubular shroud defining a fluid pathway coaxial within the shroud and a motor having a rotatable drive shaft mounted within the fluid pathway coaxial with the shroud. A hub is mounted to the shaft of the motor with the hub having a face across the fluid pathway and having an edge at the radial perimeter of the hub. A plurality of blades are mounted radially to the hub, each of the plurality of blades set with an attack angle with respect to the fluid pathway. A set of guide vanes is disposed axially with respect to the plurality of blades and mounted within the fluid pathway. The hub has at least one face orifice in the face of the hub communicating with at least one edge orifice in the edge of the hub allowiing fluid flow through the hub. In preferred embodiments, the tubular shroud is cylindrical in cross section and the plurality of blades are mounted to the edge of the hub. In a still preferred embodiment, the hub has no radial partitions under the face of the hub and between a shaft mounting portion and the edge of the hub. In preferred embodiments the axial flow fan has a plurality of face orifices in the face of the hub communicating with a plurality of edge orifices in the edge of the hub allowing a plurality of fluid pathways through the hub. In a preferred embodiment, the cumulative cross-sectional area of the plurality of edge orifices is at least as great as the cumulative cross sectional area of the plurality of face orifices. In a preferred embodiment, the number of the plurality of edge orifices equals the number of the plurality of blades.

The present invention also provides an axial fluid flow energy converter. The converter has a tubular shroud defining a fluid pathway coaxial with the shroud. A rotational energy converter (e.g. a generator) is mounted within the fluid pathway coaxial with the shroud. The rotational energy converter has a rotatable shaft. An impeller is mounted to the shaft. The impeller has a hub having a face across the fluid pathway, and has an edge at the radial perimeter of the hub. The impeller also has a plurality of blades mounted radially to the edge of the hub. Each of the plurality of blades is set with an attack angle with respect to the fluid pathway. The hub has at least one face orifice in the face of the hub communicating with at least one edge orifice in the edge of the hub allowing fluid to flow through the hub. The axial fluid flow energy converter also has a set of guide vanes disposed axially with respect to the impeller and mounted within the fluid pathway.

The additional fluid pathway(s), in conjunction with the blades, guide vanes, and shroud provide significant operating advantages over conventional design. It has been shown that the axial flow fan device of the present invention increases either or both the pressure pumping capability and the volumetric flow while at the same time, reduces the electrical energy consumption of the electric motor. It is believed that the interaction of the axial pumping of the blades combined with the pumping of air resulting from the additional fluid pathway(s) through the hub results in these significant and unexpected desirable operating characteristics.

BRIEF DESCRIPTION OF THE DRAWINGS

The foregoing advantages, construction and operation of the present invention will become more readily apparent from the following description and accompanying drawings in which.

DETAILED DESCRIPTION OF THE PREFERRED EMBODIMENTS

Figure 1:
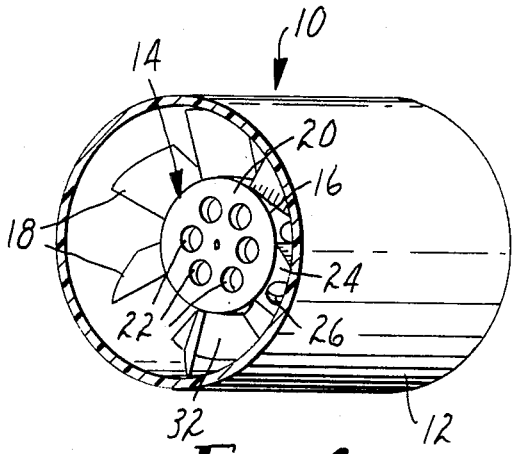
FIG. 1 is an isometric view of the complete axial flow device of the present invention.
Figure 2:
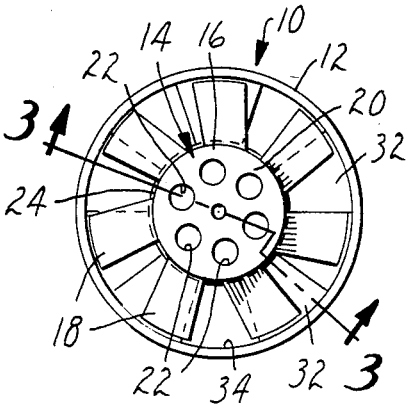
FIG. 2 is an end view of the axial flow device of the present invention.

FIGS. 1 and 2 illustrate the complete axial fluid flow energy converter or axial flow fan 10 of the present invention. A tubular shroud 12 defines the fluid pathway in which an impeller 14 is mounted. The impeller 14 has a hub 16 with a plurality of blades 18 radially mounted on the edge of the hub 16. The face 20 of the hub 16, across the fluid pathway 34, has a pluraity of face orifices 22 through which fluid may enter, or exit depending upon the design of the device. In the preferred embodiment of FIG. 1 a plurality of face orifices 22 are illustrated. It is to be understood, of course, that it is considered within the scope of the present invention that a single face orifice 22 could be utilized to obtain the multiple fluid pathways of the present invention. The edge 24 of the hub 16 to which the blades 18 are mounted also contain a plurality of edge orifices 26. Edge orifices 26 communicates with face orifices 22 to form an exit, or an entrance depending upon device design, for the multiple fluid pathway through the hub 16. While the preferred embodiment illustrated in FIGS. 1 and 2 show a plurality of edge orifices 26, it is to be understood that it is within the scope of the invention that a single edge orifice 26 could be utilized to obtain the multiple fluid pathways of the present invention. Disposed axially with respect to the impeller 14 is a set of guide vanes 32 which are utilized in a conventional manner. In the preferred embodiment illustrated in FIGS. 1 and 2, the guide vanes 32 are disposed aft the impeller 14 with respect to the fluid flow. However, in other embodiments the guide vanes 32 may be disposed on either or both sides of the impeller 14.

Figure 3:
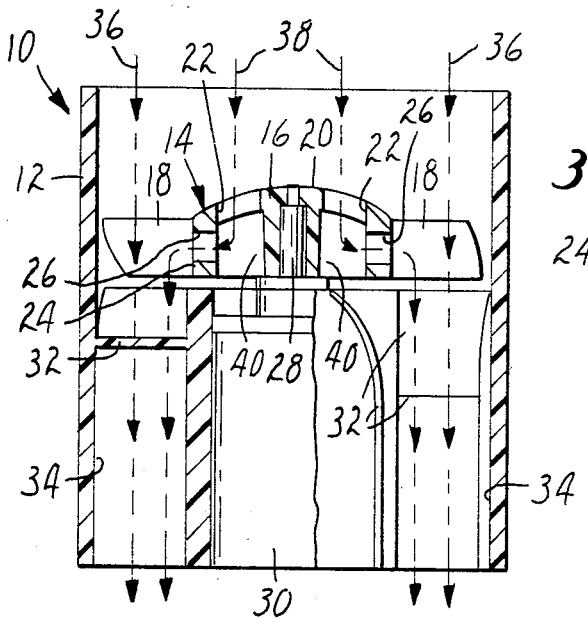
FIG. 3 is a sectional view of the axial flow device of FIG. 2 illustrating the multiple fluid pathways.

FIG. 3 illustrates a cross section of the device 10 of FIG. 2 taken along Section Line 3—3. Again a tubular shroud 12, which preferably is cylindrical, defines a fluid pathway 34. The impeller 14 is mounted axially in the fluid pathway 34 and has a hub portion 16 and a plurality of blades 18. The blades 18 are set at an attack angle with respect to the fluid in order to pump that fluid, e.g. air. The face 20 of the hub 16 across the fluid pathway 34 contains face orifices 22. The edge 24 of the hub 16 contain edge orifices 26. Guide vanes 32 are disposed axially with respect to the impeller 14 also within the fluid pathway 34. The impeller 14 is mounted on the drive shaft 28 of motor 30.

Conventional axial fluid flow 36 is illustrated in FIG. 3 entering the fluid pathway 34 at the top of the tubular shroud 12. This axial fluid flow 36 is produced conventionally by the blades 18 in conjunction with guide vanes 32. FIG. 3 also illustrates the multiple fluid pathways created by the face orifices 22 and edge orifices 26. A hub fluid flow 38, not present in conventional axial flow fan design, is created by face orifices 22 and edge orifices 26. In operation, hub fluid flow 38 is formed when the fluid passes through face orifice 22, through the interior 40 of hub 16, exiting through edge orifice 26 acting in conjunction with blade 18 and guide vane 32 and continuing through the fluid pathway 34. This hub fluid flow 38 is not present in conventional impeller 14 and axial flow device 10 design. It is the hub fluid flow 38 in conjunction with conventional axial fluid flow 36 which produces the striking operating characteristics of the device of the present invention.

Figure 4:
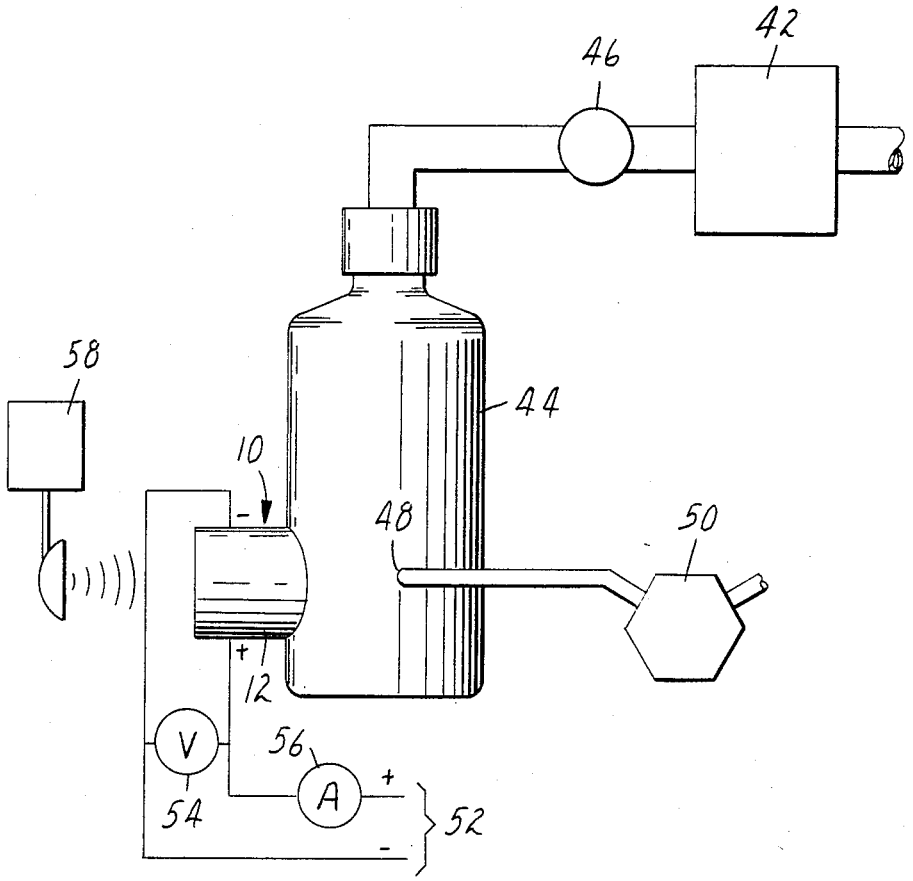
FIG. 4 illustrates in diagrammetric form a test set up used to determine the operative effects of the present invention.

The test arrangement illustrated in FIG. 4 allows the measurement of the volume of air through the device 10 under a variety of pressure loadings and at a variety of impeller 14 speed conditions. A subject axial flow device 10 is mounted with respect to an exhaust chamber 44. An auxiliary blower 42 can be used to create a range of static pressure conditions in the exhaust chamber 44. A flow meter 46 can measure the volume of air flowing through the device 10. A static pressure tap 48 coupled to a manometer 50 allows the exhaust chamber 44 pressure to be monitored. The static pressure tap 48 is referenced against ambient atmosphere whose pressure is the device 10 inlet pressure. Thus the static pressure tap measures the pressure load across the device 10. The device 10 is coupled to a power source with leads 52 whose power concumption is monitored by volt meter 54 and ammeter 56. The speed of the impeller 14 of the device 10 is monitored by a Strobotac 58. In a preferred embodiment the following equipment is utilized:

| Device | Reference Numeral | Instrument |
|---|---|---|
| Flow meter | 46 | Fisher Porter Rotometer Tube No. FP 227G 10/55, 1.8–22.8 cfm |
| Manometer | 50 | Magnehelic Catalog No. 2001C 0.0–1.0 inches water |
| Volt meter | 54 | Fluke 8024A digital multimeter and Fluke 8000A digital multimeter; |
| Ammeter | 56 | Hewlett-Packard 6291A direct current power supply and Fluke 8000A digital multimeter; |
| Strobotac | 58 | General Radio Strobotac 1531AB; |
| Barometric pressure | (none) | Fisher Scientific Mercury Barometer 0.0–32.7 inches Hg; |
| Ambient temperature | (none) | Curtin Matheson No. 227-066, −30° F. to +120° F. thermometer; and |
| Relative Humidity | (none) | Abbeon Indicator Model M2A4B. |

The fluid stream energy in watts may be found by first determining the product of the actual pounds of fluid (e.g. air) flowing through the device 10 per second, times the pressure differential across the device 10 expressed in feet of fluid at the flowing condition and dividing this product by 550 to determine the fluid horsepower, and finally by multiplying the result by 745.7 to obtain watts. The energy in watts supplied to the motor 30 is the product of the motor voltage and motor amperage using volt meter 54 and ammeter 56. Combining such operations yields the following squations:

$$\text{Device Efficiency (\%)} = 11.75 \times \frac{F \times P}{V \times A},$$

where

F equals the flow rate in cubic feet per minute,

P equals the pressure gain in inches of water,

V equals the voltage of the volt meter 54 in volts, and

A equals the current of ammeter 56 in amperes.

The actual atmospheric conditions for a given test are used to correct the measured readings to actual flow in cubic feet per minute. The correction is accomplished by the use of the following equation:

Actual Flow =

$$\text{Indicated Flow } (ICFM)\ \frac{14.7}{Pa}\ \frac{Ta}{530}\ \sqrt{\frac{Pa}{14.7}\ \frac{530}{Ta}}$$

where Pa equals atmospheric pressure in pounds per square inch ambient and Ta equals atmospheric temperature in degrees Rankine.

The test set up in FIG. 4 was used by setting the device 10 voltage and the auxiliary blower 42 flow until the pressure gain across the device was 0.0 (free air condition). The impeller 14 speed, the voltage, the amperage, and the indicated air flow were then recorded. The pressure gain across the fan was then adjusted by varying auxiliary blower 42 in a stepwise manner and all readings were again repeated until the auxiliary blower 42 was no longer energized, at which point the device was under maximum test pressure and minimum test flow.

Figure 5:
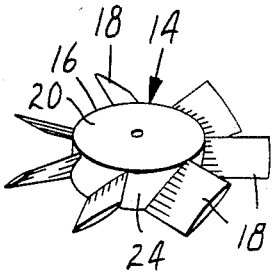
FIG. 5 PRIOR ART
FIG. 5 is a prior art impeller.

FIG. 5 illustrates a prior art impeller 14. The prior art impeller 14 has a hub 16 and a plurality of blades 18 radially affixed to the edge 24 of the hub 16. The hub 16 has a face 20 across the fluid flow which prevents fluid passage through the hub 16.

Figure 6:
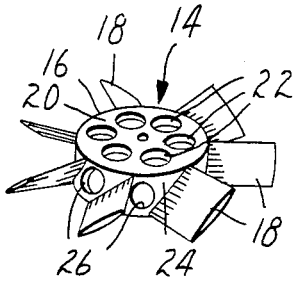
FIG. 6 is an impeller modified to form the multiple fluid pathways of the present invention.

The multiple fluid pathway impeller 14 of the present invention is more readily illustrated with FIG. 6. Again, impeller 14 has a hub 16 and a plurality of blades radially affixed to the edge 24 of the hub 16. The face 20 of the hub 16 across the fluid pathway contains face orifices 22, or at least one, and the edge 24 of the hub 16 contain edge orifices 26, or at least one. The interior 40 of the hub 16 allows fluid passing through face orifices 22 to communicate with edge orifices 26. The use of the face orifices 22 in conjunction with the edge orifices 26 creates the multiple fluid pathways which result in the favorable operation of the present invention.

The striking results of the impeller 14 of the present invention can be illustrated by a test utilizing the test set up of FIG. 4. In this test the prior art impeller 14 of FIG. 5 was compared with the impeller 14 of the present invention illustrated in FIG. 6. The test was conducted with a motor 30 voltage of 5.2 volts in a room temperature of 80° Fahrenheit (23° Centigrade) with a barometric pressure of 736 Torr. The fluid flow, pressure differential, current draw, impeller speed and efficiency of the device utilizing the selected impeller are illustrated in Table 1.

TABLE 1

| FLOW (ACFM) | | PRESSURE ("$H_2O$) | | CURRENT (AMPS) | | SPEED (RPM) | | EFFICIENCY (%) | |
|---|---|---|---|---|---|---|---|---|---|
| FIG. 5 | FIG. 6 | FIG. 5 | FIG. 6 | FIG. 5 | FIG. 6 | FIG. 5 | FIG. 6 | FIG. 5 | FIG. 6 |
| 18.05 | 18.41 | 0.00 | 0.00 | 0.43 | 0.42 | 14550 | 14600 | 0 | 0 |
| 17.02 | 17.59 | 0.10 | 0.10 | 0.44 | 0.425 | 14550 | 14600 | 8.74 | 9.36 |
| 16.00 | 16.77 | 0.20 | 0.20 | 0.445 | 0.43 | 14500 | 14500 | 16.26 | 17.63 |
| 14.56 | 15.65 | 0.30 | 0.30 | 0.44 | 0.43 | 14500 | 14500 | 22.44 | 24.68 |
| 12.40 | 14.01 | 0.40 | 0.40 | 0.445 | 0.435 | 14500 | 14475 | 25.20 | 29.12 |
| 8.90 | 11.35 | 0.50 | 0.50 | 0.47 | 0.435 | 14400 | 14475 | 21.40 | 29.49 |
| 6.67 | 8.49 | 0.60 | 0.60 | 0.51 | 0.46 | 14200 | 14375 | 17.74 | 25.03 |
| 5.64 | 7.77 | 0.65 | 0.65 | 0.53 | 0.49 | 14100 | 14250 | 15.64 | 23.30 |
| 4.72 | 6.55 | 0.70 | 0.70 | 0.55 | 0.52 | 14000 | 14150 | 13.58 | 19.93 |
| 3.08 | 3.48 | 0.78 | 0.83 | 0.57 | 0.57 | 13850 | 13900 | 9.53 | 11.46 |

As can be seen in Table 1, the fluid flow under "free air" conditions of 0.0 inches water pressure load is approximately equal for the prior art impeller 14 of FIG. 5 as for the impeller 14 of the present invention of FIG. 6. However, as the pressure load increases the multiple fluid pathway impeller of FIG. 6 provides significantly more flow. At 0.70 inches of water the flow increase is approximately 38%. At this point the current drain is reduced and the impeller speed is greater. Therefore, significantly more fluid (air) is being delivered with lower power consumption. The result is that the user of the device 10 of the present invention, when coupled to a powered respirator or other device, will experience additional air flow and longer battery life. The efficiency of the impeller 14 of FIG. 6 is above the efficiency for the impeller of FIG. 5 by as much as 49% (at 0.65 inches of water).

The import of axial fluid flow 38 in obtaining the improved performance of the device of the present invention can be further illustrated with another test performed with the test arrangement of FIG. 4. In this test the impeller 14 of FIG. 6 was utilized. The use of this impeller 14 in the multiple fluid pathway environment was compared with a similar environment in which the axial fluid flow 38 through the edge orifices 26 blocked with a cylindrical ridge (not shown) affixed the motor 30 housing. The test was conducted with a motor 30 voltage of 5.2 volts in a room temperature of 74° Fahrenheit (21° Centigrade) with a barometric pressure of 732 Torr (with the cylindrical ridge) and 740 Torr (without the cylindrical ridge). The fluid flow, pressure differential, current draw, impeller speed and efficiency are illustrated in Table 2.

TABLE 2

| FLOW (ACFM) | | PRESSURE ("$H_2O$) | | CURRENT (AMPS) | | SPEED (RPM) | | EFFICIENCY (%) | |
|---|---|---|---|---|---|---|---|---|---|
| Ridge | No Ridge | Ridge | No Ridge | Ridge | No Ridge | Ridge | No Ridge | Ridge | No Ridge |
| 18.41 | 18.21 | 0.00 | 0.00 | 0.42 | 0.425 | 14600 | 14325 | 0 | 0 |
| 17.59 | 17.29 | 0.10 | 0.10 | 0.425 | 0.43 | 14600 | 14275 | 9.36 | 9.09 |
| 16.77 | 16.38 | 0.20 | 0.20 | 0.43 | 0.435 | 14500 | 14250 | 17.63 | 17.02 |
| 15.65 | 15.26 | 0.30 | 0.30 | 0.43 | 0.435 | 14500 | 14250 | 24.68 | 23.78 |
| 14.01 | 13.43 | 0.40 | 0.40 | 0.435 | 0.435 | 14475 | 14250 | 29.12 | 28.56 |
| 11.35 | 11.09 | 0.50 | 0.50 | 0.435 | 0.43 | 14475 | 14250 | 29.49 | 29.14 |
| 8.49 | 8.85 | 0.60 | 0.60 | 0.46 | 0.44 | 14375 | 14225 | 25.03 | 27.27 |
| 7.77 | 7.93 | 0.65 | 0.65 | 0.49 | 0.45 | 14250 | 14200 | 25.30 | 25.88 |
| 6.55 | 7.32 | 0.70 | 0.70 | 0.52 | 0.46 | 14150 | 14150 | 19.93 | 25.17 |

TABLE 2-continued

| FLOW (ACFM) | | PRESSURE ("$H_2O$) | | CURRENT (AMPS) | | SPEED (RPM) | | EFFICIENCY (%) | |
|---|---|---|---|---|---|---|---|---|---|
| Ridge | No Ridge | Ridge | No Ridge | Ridge | No Ridge | Ridge | No Ridge | Ridge | No Ridge |
| 5.11 | 6.31 | 0.75 | 0.75 | 0.54 | 0.47 | 14050 | 14100 | 16.04 | 22.75 |
| 3.48 | 3.87 | 0.83 | 0.87 | 0.57 | 0.50 | 13900 | 14000 | 11.46 | 15.22 |

As can be seen from Table 2, the effect of the removal of the cylindrical ridge is evident above pressures of 0.70 inches of water by increased fluid flow, significantly greater efficiency, and lower current drain.

Figure 7:
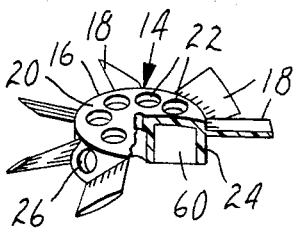
FIG. 7 is an alternative impeller according to the present invention with internal hub ribs.
Figure 8:
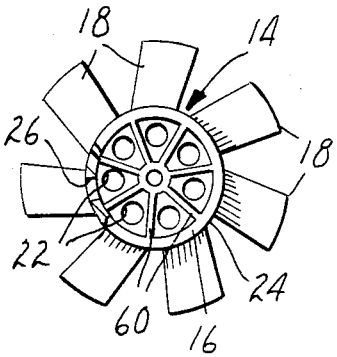
FIG. 8 is a bottom view of the impeller of FIG. 7.

The impeller 14 illustrated in FIGS. 7 and 8 is similar to the impeller 14 of FIG. 6. Both impellers 14 have a hub 16 to which are radially attached blades 18. Both have face orifices 22 in the face 20 of the hub 16 and edge orifices 26 on the edge 24 of hub 16. However, where the hub 16 of impeller 14 of FIG. 6 is open allowing free communication between face orifices 22 and edge orifices 26, impeller 14 of FIGS. 7 and 8 feature internal hub ribs 60 extending radially between the portion of the hub 16 supporting the drive shaft 28 and the edge 24. The effect of the ribs 60 is to limit fluid passage from one face orifice 22 to a single edge orifice 26. Note that multiple fluid pathways are still available through the hub 16 of the impeller 14 of FIGS. 7 and 8.

The operation of an impeller 14 as described in FIGS. 7 and 8 was tested with an impeller 14 similar to, although not identical to, the impeller described in FIG. 6. The test voltage was 5.2 volts, the room temperature was 75° Fahrenheit, (22° Centigrade) and the barometric pressure was 734 Torr. The results of this experiment are shown in Table 3.

TABLE 3

| FLOW (ACFM) | | PRESSURE ("$H_2O$) | | CURRENT (AMPS) | | SPEED (RPM) | | EFFICIENCY (%) | |
|---|---|---|---|---|---|---|---|---|---|
| FIGS. 7 & 8 | FIG. 6 | FIGS. 7 & 8 | FIG. 6 | FIGS. 7 & 8 | FIG. 6 | FIGS. 7 & 8 | FIG. 6 | FIGS. 7 & 8 | FIG. 6 |
| 18.61 | 18.40 | 0.00 | 0.00 | 0.46 | 0.41 | 14000 | 14250 | 0.0 | 0.0 |
| 17.79 | 17.58 | 0.10 | 0.10 | 0.46 | 0.415 | 14000 | 14200 | 8.74 | 9.57 |
| 16.77 | 16.56 | 0.20 | 0.20 | 0.465 | 0.42 | 13975 | 14200 | 16.30 | 17.82 |
| 15.74 | 15.54 | 0.30 | 0.30 | 0.47 | 0.425 | 13950 | 14150 | 22.70 | 24.97 |
| 13.49 | 13.90 | 0.40 | 0.40 | 0.46 | 0.42 | 14000 | 14200 | 26.51 | 29.91 |
| 11.14 | 11.25 | 0.50 | 0.50 | 0.465 | 0.42 | 13975 | 14200 | 27.07 | 30.26 |
| 8.79 | 9.41 | 0.60 | 0.60 | 0.48 | 0.43 | 13925 | 14150 | 24.83 | 29.67 |
| 7.26 | 7.57 | 0.70 | 0.70 | 0.49 | 0.44 | 13900 | 14100 | 23.44 | 27.21 |
| 5.32 | 5.62 | 0.80 | 0.80 | 0.48 | 0.45 | 13925 | 14050 | 20.04 | 22.58 |
| 3.58 | 3.48 | 0.85 | 0.85 | 0.48 | 0.46 | 13925 | 14000 | 14.33 | 14.53 |

Table 3 shows that while the overall effect of the hub ribs 60 is negative when compared to an impeller 14 of the type of FIG. 6, that the impeller 14 illustrated in FIGS. 7 and 8 still operates substantially better than the prior art impeller 14 of FIG. 5. The impeller 14 of FIGS. 7 and 8 requires somewhat more current at all conditions and the fluid flow and the impeller speed are both slightly reduced at pressures above 0.30 inches of water. These effects combine to reduce the efficiency over all ranges of operation slightly as compared to the impeller 14 similar to that described in FIG. 6. The benefit, however, of the ribs 60 is to add hub strength.

Figure 9:
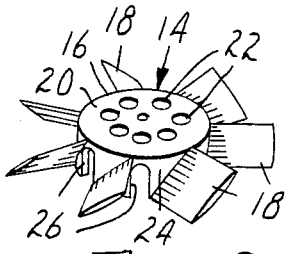
FIG. 9 is an alternative impeller according to the present invention with notches forming edge orifices.
Figure 10:
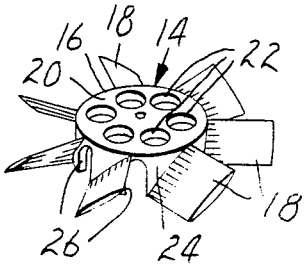
FIG. 10 is an alternative impeller according to the present invention.

The impellers 14 illustrated in FIGS. 9 and 10 are similar to the impellers 14 illustrated in FIG. 6. FIGS. 9 and 10 illustrate, however, that the edge orifices 26 need not be circular passageways through the edge 24 of the hub 16. In FIGS. 9 and 10 the impellers 14 have edge orifices constructed of notches in the edge 24 creating a somewhat different fluid passageway. The impellers 14 of FIGS. 9 and 10, however, operate substantially fundamentally as advantageously as the impeller 14 illustrated in FIG. 6. Results of tests utilizing impellers 14 as illustrated in FIGS. 9 and 10 are summarized in Table 4. The test voltage was 5.2 volts, the room temperature was 75° Fahrenheit, (22° Centigrade) and the barometric pressure was 740 Torr.

TABLE 4

| FLOW (ACFM) | | PRESSURE ("$H_2O$) | | CURRENT (AMPS) | | SPEED (RPM) | | EFFICIENCY (%) | |
|---|---|---|---|---|---|---|---|---|---|
| FIG. 9 | FIG. 10 | FIG. 9 | FIG. 10 | FIG. 9 | FIG. 10 | FIG. 9 | FIG. 10 | FIG. 9 | FIG. 10 |
| 18.12 | 18.53 | 0.0 | 0.0 | 0.40 | 0.41 | 14500 | 14450 | 0 | 0 |
| 17.41 | 17.51 | 0.10 | 0.10 | 0.41 | 0.415 | 14450 | 14425 | 9.59 | 9.53 |
| 16.49 | 16.69 | 0.20 | 0.20 | 0.42 | 0.42 | 14425 | 14400 | 17.74 | 17.95 |
| 15.07 | 15.27 | 0.30 | 0.30 | 0.42 | 0.42 | 14425 | 14400 | 24.31 | 24.64 |
| 12.62 | 13.03 | 0.40 | 0.40 | 0.41 | 0.41 | 14450 | 14450 | 27.82 | 28.72 |
| 10.49 | 10.38 | 0.50 | 0.50 | 0.43 | 0.42 | 14400 | 14400 | 27.55 | 27.92 |
| 8.65 | 8.65 | 0.60 | 0.60 | 0.44 | 0.43 | 14350 | 14350 | 26.66 | 27.27 |
| 7.94 | 8.14 | 0.65 | 0.65 | 0.46 | 0.44 | 14250 | 14300 | 25.35 | 27.17 |
| 7.22 | 7.22 | 0.70 | 0.70 | 0.46 | 0.45 | 14250 | 14250 | 24.85 | 25.31 |
| 6.22 | 6.52 | 0.75 | 0.75 | 0.475 | 0.46 | 14200 | 14250 | 23.61 | 24.02 |
| 5.50 | 5.70 | 0.80 | 0.80 | 0.50 | 0.49 | 14050 | 14100 | 19.87 | 21.02 |
| 3.36 | 3.46 | 0.84 | 0.85 | 0.56 | 0.54 | 13800 | 14000 | 11.38 | 12.30 |

It can be seen in Table 4 that the impellers 14 illustrated in FIGS. 9 and 10 both have the improved operating characteristics of the multiple fluid pathway impellers of the present invention. The impeller 14 of FIG. 9 has seven face orifices 22, each with a diamater of 0.10 inches. This compares with the impeller 14 of FIG. 10 which has six face orifices 22, each of 0.187 inch diameter. It will be noted that the performance of the impellers 14 of FIGS. 9 and 10 are nearly equal. A slight gain in efficiency is seen for the impeller 14 of FIG. 10.

The impellers 14 of FIG. 9 and FIG. 10 illustrate that the multiple fluid pathways of the invention can be allowed by edge orifices 26 of differing shapes and configurations. In addition, the edge orifices 26 may be formed from the clearance between the portion of the edge 24 of the impeller 14 closest the motor 30 and the motor 30 housing. The clearance between the edge 24 of the impeller 14 and the motor 30 allows fluid to enter face orifices 22, pass through the impeller 14 and exit onto the guide vanes 32 at or near the blades 18 to form the multiple fluid pathway. The result was confirmed in the test set-up of FIG. 4 in which impellers 14 were compared. The first (small) impeller 14 had a small gap (clearance) of 0.053 inches between the edge 24 and the face of the motor 30 housing. The second (large) impeller 14 had a larger gap (clearance) of 0.093 inches between the edge 24 and the face of the motor 30 housing. The blade 18 to guide vane 32 clearance was held constant. No other edge orifices 26 were used other than the edge 24 clearance. The test voltage was 5.2 volts, the room temperature was 76° Fahrenheit (22.5° Centigrade) and the barometric pressure was 739 Torr. The fluid flow, pressure differential, current draw, impeller speed and efficiency are illustrated in Table 5.

TABLE 5

| FLOW (ACFM) | | PRESSURE ("$H_2O$) | | CURRENT (AMPS) | | SPEED (RPM) | | EFFICIENCY (%) | |
|---|---|---|---|---|---|---|---|---|---|
| Small | Large | Small | Large | Small | Large | Small | Large | Small | Large |
| 18.56 | 18.56 | 0.00 | 0.00 | 0.43 | 0.43 | 14350 | 14425 | 0.00 | 0.00 |
| 17.54 | 17.74 | 0.10 | 0.10 | 0.44 | 0.43 | 14325 | 14400 | 9.00 | 9.32 |
| 16.82 | 16.92 | 0.20 | 0.20 | 0.45 | 0.44 | 14300 | 14350 | 16.89 | 17.37 |
| 15.81 | 15.90 | 0.30 | 0.30 | 0.45 | 0.44 | 14300 | 14350 | 23.81 | 24.49 |
| 14.07 | 14.27 | 0.40 | 0.40 | 0.44 | 0.45 | 14325 | 14325 | 28.90 | 28.66 |
| 10.60 | 11.01 | 0.50 | 0.50 | 0.45 | 0.44 | 14300 | 14350 | 26.61 | 28.27 |
| 8.77 | 8.87 | 0.60 | 0.60 | 0.45 | 0.44 | 14300 | 14350 | 26.42 | 27.33 |
| 7.75 | 8.05 | 0.65 | 0.65 | 0.46 | 0.44 | 14250 | 14350 | 24.74 | 26.87 |
| 6.83 | 7.24 | 0.70 | 0.70 | 0.47 | 0.45 | 14200 | 14300 | 22.98 | 25.44 |
| 6.22 | 6.32 | 0.75 | 0.75 | 0.48 | 0.46 | 14150 | 14250 | 21.96 | 23.28 |
| 4.99 | 5.30 | 0.80 | 0.80 | 0.49 | 0.47 | 14100 | 14200 | 18.40 | 20.38 |
| 3.26 | 3.36 | 0.83 | 0.84 | 0.53 | 0.49 | 14000 | 14100 | 11.53 | 13.01 |

As Table 5 illustrates, the impeller 14 with the larger clearance demonstrated an increasing fluid flow while reducing current drain. The efficiency improves as well.

Figure 11:
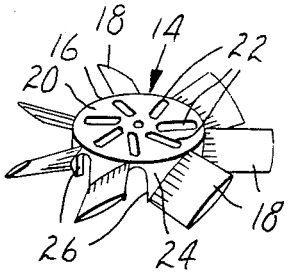
FIG. 11 is an alternative impeller according to the present invention with slots for face orifices.

The impeller 14 illustrated in FIG. 11 shows an alternative geometry for face orifices 22 in the face 20 of hub 16. FIG. 11 illustrates that the face orifices 22 need only admit fluid through the face 20 of the hub 16 for communication to edge orifices 26. The particular cross-sectional shape of face orifices 22 is not critical.

Thus, it can be seen that there has been shown and described a novel axial flow device. It is to be understood, however, that various changes, modifications, and substitutions in the form of the details of the described device can be made by those skilled in the art without departing from the scope of the invention as defined by the following claims.

What is claimed is:

1. An axial flow fan, comprising:

a tubular shroud defining a fluid pathway coaxial with said shroud;

a motor mounted within said fluid pathway coaxial with said shroud, said motor having a rotatable drive shaft;

a hub mounted to said shaft of said motor, said hub having a face across said fluid pathway and having an edge at the radial perimeter of said hub;

a plurality of blades of uniform cross-section mounted radially to said hub, each of said plurality of blades set with an attack angle with respect to said fluid pathway; and a set of guide vanes disposed axially with respect to said plurality of blades and mounted within said fluid pathway;

said hub having at least one face orifice in said face of said hub communicating with at least one edge orifice in said edge of said hub, said at least one edge orifice being located between two adjacent of said pluality of blades, allowing fluid flow through said hub, to operate in conjunction with said at least one of said plurality of blades and said set of guide vanes to provide increased efficiency of said axial flow fan.

2. An axial flow fan as in claim 1 wherein said tubular shroud is cylindrical in cross-section.

3. An axial flow fan as in claim 2 wherein said plurality of blades are mounted to said edge of said hub.

4. An axial flow fan as in claim 3 wherein said hub has no radial partitions under said face of said hub and between a shaft mounting portion and said edge of said hub.

5. An axial flow fan as in claim 3 wherein said hub has a plurality of face orifices in said face of said hub communicating with a plurality of edge orifices in said edge of said hub allowing a plurality of fluid pathways through said hub.

6. An axial flow fan as in claim 5 wherein the number of said plurality of edge orifices equals the number of said plurality of blades.

7. An axial flow fan as in claim 5 wherein the cumulative cross-sectional area of said plurality of edge orifices is at least as great as the cumulative cross-sectional area of said plurality of face orifices.

8. An axial flow fan as in claim 5 wherein said plurality of face orifices are circular in cross-section.

9. An axial flow fan as in claim 8 wherein said plurality of edge orifices are circular in cross-section.

10. An axial flow fan as in claim 8 wherein said plurality of edge orifices are formed by a notch in said edge of said hub.

11. An axial fluid flow energy converter, comprising:

a tubular shroud defining a fluid pathway coaxial with said shroud;

a rotational energy converter mounted within said fluid pathway coaxial with said shroud, said rotational energy converter having a rototable shaft;

an impeller mounted to said shaft, said impeller having a hub having a face across said fluid pathway and having an edge at the radial perimeter of said hub, and having a plurality of blades of uniform cross-section mounted radially to said edge of said hub, each of said plurality of blades set with an attack angle with respect to said fluid pathway, said hub having at least one face orifice in said face of said hub communicating with at least one edge orifice in said edge of said hub, said at least one edge orifice being located between two adjacent of said plurality of blades, allowing fluid flow through said hub to operate in conjunction with said at least one of said plurality of blades and said set of guide vanes to provide increased efficiency of said axial flow energy converter; and a set of guide vanes disposed axially with respect to said impeller and mounted within said fluid pathway.

12. A converter as in claim 11 wherein said fluid is air.

13. A converter as in claim 12 wherein said tubular shroud is cylindrical in cross-section.

14. A converter as in claim 13 wherein said rotational energy converter is a rotational energy/electrical energy converter.

15. A converter as in claim 14 wherein said set of guide vanes is mounted aft of said impeller with respect to said fluid flows.

16. A converter as in claim 14 wherein there is at least one of said at least one edge orifice corresponding to each one of said plurality of blades.

17. A converter as in claim 14 wherein said hub has a plurality of face orifices in said face of said hub communicating with a plurality of edge orifices in said edge of said hub allowing a plurality of fluid pathways through said hub to said plurality of blades.

18. A converter as in claim 17 wherein the cumulative cross-sectional area of said plurality of edge orifices is at least as great as the cumulative cross-sectional area of said plurality of face orifices.

* * * * *

UNITED STATES PATENT AND TRADEMARK OFFICE

CERTIFICATE OF CORRECTION

PATENT NO. : 4,583,911

DATED : April 22, 1986

INVENTOR(S) : David L. Braun

It is certified that error appears in the above-identified patent and that said Letters Patent is hereby corrected as shown below:

Col. 7, line 57, in Table 3, "24.97" should read --24.79--.
Col. 10, line 15, "pluality" should read --plurality--.

Signed and Sealed this

*Twenty-ninth* Day of *July 1986*

[SEAL]

*Attest:*

DONALD J. QUIGG

*Attesting Officer*

*Commissioner of Patents and Trademarks*